United States Patent [19]

Katayama et al.

[11] Patent Number: 4,885,136

[45] Date of Patent: Dec. 5, 1989

[54] METHOD OF ANTICORROSIVE TREATMENT FOR SOFT WATER BOILERS

[75] Inventors: Sakae Katayama, Osaka; Hirohiko Katayama; Toshihiko Mukai, both of Nishinomiya; Yoshinari Kawasaki, Osaka, all of Japan

[73] Assignee: Katayama Chemical Works Co., Ltd., Osaka, Japan

[21] Appl. No.: 108,764

[22] Filed: Oct. 15, 1987

[30] Foreign Application Priority Data

Oct. 17, 1986 [JP] Japan ..... 61-248075

[51] Int. Cl.[4] ..... C23F 11/10

[52] U.S. Cl. ..... 422/15; 252/389.2; 422/17; 422/18; 422/19

[58] Field of Search ..... 422/7, 15, 17, 18, 19; 252/389.2

[56] References Cited

U.S. PATENT DOCUMENTS

| | | | |
|---|---|---|---|
| 3,532,639 | 10/1970 | Hatch | 422/15 |
| 3,671,448 | 6/1972 | Kowalski | 422/15 |
| 3,738,806 | 6/1973 | Feiler | 422/15 |
| 3,901,651 | 8/1975 | Benner et al. | 422/15 |
| 4,018,701 | 4/1977 | Ralston et al. | 422/18 |
| 4,108,790 | 8/1978 | Foroulis | 422/18 |
| 4,138,353 | 2/1979 | Lipinski | 422/12 |
| 4,303,568 | 12/1981 | May et al. | 422/13 |
| 4,512,552 | 4/1985 | Katayama et al. | |
| 4,664,884 | 5/1987 | Mullins et al. | 422/17 |

FOREIGN PATENT DOCUMENTS

| | | |
|---|---|---|
| 2512072 | 3/1983 | France . |
| 48-71738 | 9/1973 | Japan . |
| 52-100338 | 8/1977 | Japan . |
| 59-16983 | 1/1984 | Japan . |
| 61-15158 | 4/1986 | Japan . |
| 927841 | 6/1963 | United Kingdom . |
| 1455247 | 11/1976 | United Kingdom . |

*Primary Examiner*—Barry S. Richman
*Assistant Examiner*—Timothy M. McMahon
*Attorney, Agent, or Firm*—Bryan, Cave, McPheeters & McRoberts

[57] ABSTRACT

A method of anticorrosive treatment for soft water boilers to prevent iron family metals from corrosion, especially from pitting corrosion, which is characterized by adding, to a boiler water system using soft water at a high temperature, (a) a specific amount of a phosphorus compound, (b) a specific amount of a carboxylic acid compound and (c) a specific amount of a metal compound.

8 Claims, No Drawings

METHOD OF ANTICORROSIVE TREATMENT FOR SOFT WATER BOILERS

BACKGROUND OF THE INVENTION

1. Field of the Invention

The present invention relates to a method of anticorrosive treatment for soft water boilers. More particularly, it relates to a method of anticorrosive treatment for soft water boilers which is convenient to prevent corrosion in a boiler water system using soft water at high temperatures, where a ferrous metal such as iron, mild steel or cast iron is brought into contact with soft water, especially pitting corrosion.

2. Description of the Prior Art

Raw water boilers using raw water such as industrial water, well water or the like (as is), soft water boilers and pure water boilers are generally known, and in many cases the temperature of their boiler water system is set at 110° C.–400° C. under various pressures.

In soft water boilers using water from which hardness ingredients are almost all removed by pretreatment (i.e. soft water), scale troubles due to hardness ingredients are few.

However, anionic ingredients are not removed from such water, and so its corrosive tendency due to anions is rather increased and its pH is lowered.

When the pH is low and the anionic ingredients exist in abundance, the process of pitting corrosion is accelerated, which is the most frequently appearing and the most dangerous one among various corrosions of boilers which is generated locally and deeply, owing mainly to dissolved oxygen in water.

Thus, in boilers using soft water, it has been hitherto effected to protect them from generation of such pitting corrosion by removing the greater part of the dissolved oxygen in boiler feed water by means of a deaerator and further removing the remaining oxygen reductively by pouring an oxygen scavenger agent such as hydrazine, sodium sulfite or the like into the water, and then, after such two-step treatment, adding polyphosphoric acid or orthophosphorates as anticorrosive agent to the water and, if necessary, pouring an alkaline agent into the water, to keep the water at a pH of 10–12. This method is prescribed in Japan as the standard method of anticorrosive treatment for water for soft water boilers (JIS B-8233/1977; hereinafter, called the deoxidation/alkali treatment method).

In the above-mentioned deoxidation/alkali treatment method, however, the phosphates used are those compounds which show an anticorrosive effect owing to the formation of a precipitate film. Accordingly, formation of a fine and firm film cannot be expected and prevention of generation of pitting corrosion over a long period of time is difficult by such treatment method. Further, since it is impossible to add the oxygen scavenger used in combination, such as hydrazine, sodium sulfite or the like, to the water successively in a concentration corresponding accurately to the concentration of the dissolved oxygen in the feed water, the method is usually carried out by adding 1.2–1.5 times the oxygen scavenger per the estimated dissolved oxygen. Then, it sometimes happens that the addition goes to excess or falls short. When the amount added falls short, rust will generate in boilers and, when the amount added goes to excess, ammonia or sodium sulfide will generate due to decomposition of hydrazine or sodium sulfite. Generation of these ingredients is unfavorable, since they may induce corrosion of copper family metals in the vapor system of boilers.

Thus, the deoxidation/alkali treatment method is troublesome in the control of concentration and in the method of addition of each agent to be added and cannot attain a satisfactory anticorrosive effect in many cases. Moreover, hydrazine involves the problem that it has toxicity (cancerogenicity) and it must be dealt with carefully, and sodium sulfite involves the problem that a high concentration of salt, which may be brought about as the boiler water is highly concentrated, causes corrosion and accordingly it is impossible to operate the boiler with highly concentrated boiler water.

On the other hand, a combination of anticorrosive agents developed by one of the inventors of the present invention, namely using a phosphonate, a hydroxycarboxylic acid and a zirconium compound in combination (Japanese Patent Application (OPI) No. Sho 59-16983) and a method of anticorrosion using a molybdate, a citrate, an aminophosphonic acid, an azole compound, etc. in combination (Japanese Examined Patent Publication No. Sho 61-15158) have been known hitherto. However, it was difficult to attain a satisfactory anticorrosive effect by merely applying such anticorrosive agents or such method of anticorrosion to the anticorrosive treatment of iron family metals in high temperature soft water boilers, and it was still necessary for preventing generation of pitting corrosion to effect such a deoxidation treatment as the above-mentioned one and, as the case may be, also an alkali addition treatment.

The present invention is intended circumstances and intends to provide a new method of anticorrosive treatment for soft water boilers, which is convenient to protect the ferrous metals in a soft water boiler system at high temperatures from generation of corrosion, especially of pitting corrosion, without effecting any troublesome deoxidation treatment which requires use of a deaerator and addition of oxygen scavengers.

It is to be noted that, although each of the ingredients (a), (b) and (c), which is described hereinafter, and which is used in the method of the present invention has been known as a general anticorrosive ingredient (U.S. Pat. No. 4,138,353, Japanese Patent Application (OPI) Nos. Sho 48-71335 and Sho 52-103338 etc.), combined use of these three ingredients for soft water boilers has been hitherto unknown.

SUMMARY OF THE INVENTION

The inventors of the present invention have made earnest investigation on the basis of the above-mentioned viewpoint and found that, when a specific phosphorus compound, a carboxylic acid compound and, instead of the above-mentioned zirconium compound, a tin, zinc, manganese or nickel ion are added to a soft water boiler at high temperatures and their amounts existing in the soft water are adjusted to a specific ratio, pitting corrosion as well as general corrosion are remarkably prevented or controlled without effecting any deoxidation treatment. The present invention has been completed by further investigations of this fact.

Thus, the present invention provides a method of anticorrosive treatment for soft water boilers which comprises adding to a boiler water system using soft water at a high temperature (a) at least one phosphorus compound selected from the group consisting of a polyphosphoric acid, an orthophosphoric acid and an organophosphoric acid, in an amount of 10–200 mg/l, (b)

at least one carboxylic acid compound selected from the group consisting of an aliphatic hydrocarboxylic acid and an amino acid, in an amount of 40–500 mg/l and (c) at least one metal compound easily releasing in water a metal ion selected from the group consisting of a tin ion, a zinc ion, a manganese ion and a nickel ion, in an amount of 0.5–50 mg/l as metal ion, wherein the weight ratio of the compound (b) to the metal ion of the compound (c) is 3 or more, to prevent corrosion of iron family metals which may generate in the boiler water system, without effecting any deoxidation treatment.

According to the method of this invention, generation of pitting corrosion of iron family metals in a soft water boiler system at high temperatures can be prevented and general corrosion can also be controlled remarkably, without effecting any deoxidation treatment. The anticorrosive film formed at high temperatures is firm and can prevent or control various kinds of corrosions over a long period of time. Moreover, the method, which does not use any oxygen scavenger such as hydrazine or sodium sulfite, does not invite various troubles resulting from the oxygen scavenger.

Thus, anticorrosion of soft water boilers can be attained conveniently and effectively by the method of the present invention, and accordingly the method has remarkably great industrial value.

DESCRIPTION OF THE PREFERRED EMBODIMENTS

In the present invention, boilers using soft water at high temperatures means those boilers which use usual raw water such as general industrial water, softened by means of ion-exchange resins, as the feed water. The term "high temperatures" used herein means usually temperatures of higher than 150° C. (inclusive). For low temperature boilers, whose boiler water temperature is lower than 150° C., the method of the present invention is not suitable because, even if it is applied to such boilers, fine anticorrosive film is not formed and satisfactory anticorrosive effect is not attained. Although there is no special upper limits in temperatures of boiler water, usual soft water boilers are operated in many cases with boiler water temperatures lower than 250° C. (inclusive). Therefore, the temperature of boiler water of those high temperature soft water boilers which are the subject of the present invention is suitably within the range of 150°–250° C.

Among the compounds (a) used in the present invention, polyphosphoric acids are compounds represented by the general formula $(MPO_3)_n$ or $M_{m+2}P_mO_{3m+1}$ (wherein M denotes sodium, potassium or a hydrogen atom, or a combination thereof, n denotes an integer of 3–10 and m denotes an integer of 2–6), such as pyrophosphoric acid, tripolyphosphoric acid, trimetaphosphoric acid, tetrametaphosphoric acid, hexametaphosphoric acid, decametaphosphoric acid and their sodium or potassium salts, and orthophosphoric acids are compounds represented by the general formula $M_3PO_4$ (wherein M denotes a hydrogen atom, sodium or potassium, or a combination thereof), such as sodium (or potassium) primary phosphate, sodium (or potassium) secondary phosphate, sodium (or potassium) tertiary phosphate and phosphoric acid. When copper or aluminum does not exist in the condensate system, ammonium salts may be used instead of the above-mentioned sodium or potassium salts. On the other hand, organophosphoric acids are compounds having one or more group(s) in which one or two carbon atom(s) is (are) linked per one phosphorus atom, which may further have one or more (same or different) groups selected from the group consisting of amino group, hydroxyl group, carboxyl group, carbonyl group, and aldehyde group in their molecule. Those having a halogen or sulfur atom are not suitable. Preferable compounds are represented by the following formulae (I)–(III):

$$[(MO)_2P(O)CH_2]_2N[(CH_2)_mN]_k\overset{\overset{\displaystyle CH_2P(O)(OM)_2}{|}}{}CH_2P(O)(OM)_2 \qquad \text{(I)}$$

(wherein k is O or an integer of 1–2, m denotes an integer of 2–6, M denotes a hydrogen atom, sodium or potassium, and the Ms may be the same as or different from one another);

$$R-C(X)\begin{matrix}P(O)(OM)_2\\P(O)(OM)_2\end{matrix} \qquad \text{(II)}$$

(wherein X denotes OH or $NH_2$, M denotes a hydrogen atom, sodium or potassium, and the Ms may be the same as or different from one another); and $$H-[\underset{\underset{\displaystyle COOH}{|}}{CHCH_2}]_m-\underset{\underset{\displaystyle OM}{|}}{P(O)}-[\underset{\underset{\displaystyle COOH}{|}}{CHCH_2}]_n-H \qquad \text{(III)}$$

(wherein M denotes a hydrogen atom, sodium or potassium, m and n are each a positive integer, and $m+n=4$ to 20.

As examples of compounds of the formula (I), nitrilotrimethylphosphonic acid, ethylenediaminetetramethylphosphonic acid, trimethylenediaminetetramethylphosphonic acid, hexamethylenediaminetetramethylphosphonic acid, diethylenetriaminepentamethylphosphonic acid and their sodium or potassium salts are mentioned.

As examples of compounds of the formula (II), 1,1-hydroxyethanediphosphonic acid, 1,1-aminoethanediphosphonic acid, 1,1-hydroxypropanediphosphonic acid, 1,1-aminopropanediphosphonic acid and their sodium or potassium salts are mentioned.

As examples of compounds of the formula (III), bis-poly-2-carboxyethylphosphinic acids in which $m+n=4$, 10, 16 or 20, and their sodium or potassium salts are mentioned.

Among these compounds mentioned as the compound (a), sodium hexametaphosphate, sodium phosphate, potassium phosphate, nitrilotrimethylenephosphonic acid, 1,1-hydroxyethanediphosphonic acid, bis-poly-2-carboxyethylphosphinic acid (in which $m+n=16$) and sodium or potassium salts of these phosphonic acids are mentioned as preferable ones, in view of their anticorrosive effects.

Among the above-mentioned compounds (a), phosphonic acids are preferably used in view of the stability of "one-drum" formulation containing them together with the compounds (b) and the compounds (c).

When polyphosphorates or orthophosphorates are used as the compounds (a), one must usually avoid adding them in an amount of more than 40 mg/l (inclusive) as converted into residual $PO_4$, because addition of phosphates in high concentrations is accompanied by danger of "hideout". On the other hand, phosphorates are free from such anxiety and can be added in considerably higher concentrations. However, it is not practical to use them in an amount exceeding 200 mg/l, in view of their cost. Accordingly, the concentration of the compound (a) added is suitably 10–200 mg/l, more preferably 30–100 mg/l.

Among the compounds (b) used in the present invention are aliphatic hydroxycarboxylic acids and amino acids. Among aliphatic hydroxycarboxylic acids are monobasic or polybasic aliphatic carboxylic acids having one or more hydroxyl group(s) or their salts, such as glycolic acid, lactic acid, citric acid, tartaric acid, malic acid, gluconic acid, and among their sodium or potassium salts, and amino acids are monobasic or polybasic aliphatic carboxylic acids having one or more amino group(s), their N-substituted derivatives, and water-soluble salts of such acids and derivatives, such as nitrilotriacetic acid, ethylenediaminetetraacetic acid, glycine, alanine, valine, leucine, serine, threonine, aspartic acid, glutamic acid, and their sodium or potassium salts.

Among the above compounds (b), citric acid, malic acid, gluconic acid, nitrilotriacetic acid, glycine, and their sodium or potassium salts are preferred in view of their anticorrosive effect.

The concentration of these compounds (b) added is usually 40–500 mg/l, preferably 100–400 mg/l.

As the metal compounds used in the present invention as the compound (c), water-soluble tin, zinc, manganese or nickel salts are suitable. More concretely, water-soluble inorganic salts such as sulfates, nitrates, chlorides and sulfamates of the above four metals, tin, zinc, manganese and nickel, are suitable and, among them, sulfates and chlorides are preferable, being free from anxiety about generation of harmful gases in boilers. However, the water-soluble salts of the above four metals may be used with the above compounds (a) or (b) of free acid form. Examples of the chlorides and sulfates are stannous chloride, stannic chloride, stannous sulfate, stannic sulfate, zinc chloride, zinc sulfate, manganese chloride, manganese sulfate, nickel chloride and nickel sulfate. These salts may be anhydrous salts or may contain water of crystallization. Especially preferred among them are stannous chloride, stannic chloride, stannous sulfate and stannic sulfate, in view of their anticorrosive effects and the scarce formation of substances hardly soluble in water, such as phosphates, at the electric heating surface.

The concentration of these compounds (c) added is suitably 0.5–50 mg/l, preferably 5–30 mg/l, as converted into metal ion.

Although the concentration of each of the compounds (a), (b) and (c) added according to the present invention is just as described above, the total concentration of the compounds (a), (b) and (c) added is suitably 50–600 mg/l, preferably 100–500 mg/l.

The three ingredients (a), (b) and (c) may be added simultaneously or separately. However, it is suitable to prepare a formulation containing the three ingredients and add the formulation. In that case, it is preferred to prepare a formulation in the form of aqueous solution with soft water or pure water, in consideration of its use for soft water boilers. Ordinary industrial water, which may bring hardness ingredients into boilers, though their amount is small, must be avoided.

On using the above-mentioned ingredients (a), (b) and (c) in combination, it is especially important to adjust the ratio of the amount of the ingredient (b) added, to the amount of the ingredient (c) added (as converted into metal ion) at 3 or more, preferably 5 or more. When the ratio is less than 3, the effect of preventing pitting corrosion is insufficient and moreover anxiety about scaling arises. The ratio must be held strictly, especially when boilers have the possibility of leaking hardness. The ratio is to be kept at a value as high as possible. Further, composition ratios (combined use ratios) of other ingredients, based on the amount of the compound (a), are preferably (b)/(a)=1–10 and (c)/(a)=0.05–2, more favorably (b)/(a)=2–8 and (c)/(a)=0.1–0.5. The total concentration of the compounds (a), (b) and (c) in liquid preparations is suitably 5–50 wt %, preferably 15–40 wt %. Preparations containing these three ingredients can be used also in the form of powder preparations. Also in that case, it is usually preferred to blend the compounds (a), (b) and (c) in the above-mentioned ratio.

In the anticorrosion method of the present invention, other chemicals such as pH adjusting agents, anticorrosive agents for condensate systems, dispersing agents, etc. may be used simultaneously or separately in combination with the compounds (a), (b) and (c). In that case, it is also possible to form a suitable preparation containing such chemicals together with the compounds (a), (b) and (c). Especially in the case of preparations containing the anticorrosive agents for condensate systems, it is also possible to use them in the form of their water-soluble salts with phosphonic acids or hydroxycarboxylic acids, aminocarboxylic acids, etc. of the present invention. As the pH adjusting agents are mentioned sodium hydroxide and potassium hydroxide and, when copper or aluminum metal does not exist in the system, also ammonia can be used without giving any influence to the effect of the present invention. It is also possible to use sulfamic acid, sulfuric acid, etc. However, use of nitric acid and hydrochloric acid is usually avoided. As the anticorrosive agents for condensate systems, morpholine, cyclohexylamine, ethanolamine, aminomethylpropanol, propanolamine and the like can be used. As the dispersing agents, water-soluble salts of polyacrylic acid, polymaleic acid, acrylic acid/acrylic ester copolymer, acrylic acid/acrylic amide copolymer, or the like, having usually a molecular weight of about 1000–10000, can be used.

In the following, the present invention is explained by giving Examples, Referential Examples and Comparative Examples. The invention, however, shall not be limited to those Examples.

REFERENTIAL EXAMPLE 1 (Effect in an ordinary cooling water system)

An anticorrosion test in hot water was performed using a test piece. The test piece was a commercial product named "SPCC", made of mild steel and having a plate form of 50×30×1 mm with a hole having a diameter of 4 mm at the upper part. The test piece was attached to a stirring rod made of stainless steel and immersed in 1l of a test solution containing the prescribed amount of chemicals, which was laid in the lower, flat bottom beaker of a separable flask wound with a heater. The stirring rod was linked to a motor and was allowed to rotate at 100 rpm, while maintaining the water temperature at 60° C. by means of the heater and a thermostat. The test was continued for 3 days. The water used in the test was tap water of Osaka-city. After completion of the test, M.D.D. (mg/dm$^2$, day) was determined according to JIS K 0100. The results obtained are shown in Table I. Water condition of the water used is shown in Table II.

TABLE I (Referential Example)

| Experiment No. | | Ingredient (a) (mg/l) | | Ingredient (b) (mg/l) | | Ingredient (c) (mg/l) | | Degree of Corrosion (M.D.D.) | Number of Pitting |
|---|---|---|---|---|---|---|---|---|---|
| Referential Example | 1 | Sodium hexametaphosphate | 45 | Sodium gluconate | 100 | | | 20.5 | 0 |
| | 2 | Sodium hexametaphosphate | 45 | | | $ZnSO_4.7H_2O$ | 22 | 1.6 | 0 |
| | 3 | Sodium hexametaphosphate | 45 | Sodium gluconate | 100 | " | 22 | 2.8 | 0 |
| | 4 | Sodium hexametaphosphate | 45 | Sodium gluconate | 100 | $SnCl_2.2H_2O$ | 10 | 23.5 | 0 |
| | 5 | Nitrilotrimethyl-phosphonic acid | 40 | Sodium gluconate | 100 | | | 45.5 | 1 |
| | 6 | Nitrilotrimethyl-phosphonic acid | | | | $ZnSO_4.7H_2O$ | | 25.1 | 0 |
| | 7 | Nitrilotrimethyl-phosphonic acid | | Sodium gluconate | 100 | " | 22 | 16.3 | 0 |
| | 8 | Nitrilotrimethyl-phosphonic acid | | Sodium gluconate | 100 | $SnCl_2.2H_2O$ | 10 | 71.3 | 0 |
| | 9 | blank | | | | | | 264 | large numbers* (over the surface*) |

*"large numbers" means that more than 10 pittings are present
*"over the surface" means that corrosion generates on almost the whole test piece

TABLE II

Water Condition of Tap Water of Osaka-city

| Item | Unit | Value |
|---|---|---|
| pH (25° C.) | | 6.7 |
| Electric Conductivity | μs/cm | 238 |
| P Alkalinity (as $CaCO_3$) | mg/l | 0 |
| M Alkalinity (") | " | 36 |
| Total Hardness (") | " | 40 |
| Calcium Hardness (") | " | 31 |
| Chloride Ion | " | 24 |
| Sulfate Ion | " | 23 |
| Silica (as $SiO_2$) | " | 5.1 |
| Total Iron | " | 0.05 |

The M.D.D. values of the Experiments Nos. 1–9 given in Table I are the results of reexamination of those well known having anticorrosive effects for cooling systems. From the M.D.D. values, it is noted that sodium hexametaphosphate gives good results as used in combination with sodium gluconate and/or zinc ion, while nitrilotrimethylphosphonic acid does not give sufficient effects by its combined use with sodium gluconate only or with zinc ion only and is effective only by its combined use with sodium gluconate and zinc ion. The reason why the two-ingredient system does not give good results would reside in that nitrilotrimethylphosphonic acid has only low effect for such water of low hardness as the tap water of Osaka-City, though it has high effect for water containing a rather high level of hardness ingredients. For soft water, the effect would be further reduced. On the other hand, tin chloride does not give good results even by combined use of three ingredients, in contrast with zinc sulfate. The reason for the insufficient effect of tin chloride is not yet clear, although it is presumed that the ineffectiveness results from the low reactivity of tin chloride at temperatures from room temperature up to 80° C. In cooling systems, tin is scarcely used.

In Example 1 given hereinunder, the results obtained are considerably different from the common-sensible results of these Referential Examples.

EXAMPLE 1

Using an autoclave, effects of chemicals in soft water boilers were examined. Test water was a synthetic water corresponding to a 10 times concentrated water of a soft water obtained by ion-exchanging of tap water of Osaka-city with a cation-exchange resin. Water condition of the water used is shown in Table III. Prescribed amounts of chemicals were added to 1.2 l of the test water, and the water was laid in a container inside the autoclave. The same test piece as used in Referential Example 1 was attached to the stirring rod provided to the lid of the autoclave and immersed in the test liquor. The autoclave was closed tightly and deaired by means of an aspirator. At this point of time, the inside of the autoclave was a vacuum of about 15–20 mmHg. In the test solution, 10–12 mg/l of dissolved oxygen was still present. Tight closing of the autoclave was confirmed by watching the pressure gauge which showed no change in the pressure. Then, a mantle heater and a thermostat were set up and the stirring rod was linked to a motor, and the test was carried out for 2 days while rotating the stirring rod at 100 rpm and maintaining constant pressure and temperature conditions of 15 $Kgf/cm^2$ and approx. 200° C.

After completion of the test, the test piece was washed with pure water and, after drying, anticorrosive strength of the film formed during the test was examined. In a beaker was laid 200 cc of 15% aqueous hydrochloric acid solution, and the test piece was immersed in the acid solution while keeping its temperature at 20°±2° C. The solution has a strong eroding and dissolving property against the film formed. Therefore, the film formed on the surface began to be dissolved as the time passed, and finally disappeared. Measurement of the time was effected by means of a stopwatch. Firstly, the test piece was immersed in the acid solution to the half for 5 seconds, and then washed with water immediately after it was drawn up. After wiping off the water, the change of the portion of the test piece, that had been immersed in the acid solution, was observed. Next, the same portion was again immersed in the acid solution for 10 seconds and, after drawn up, subjected to the same procedure and observation. This process was repeated at every 10 seconds, until the surface of the test piece reached almost the grounding iron. At the time point when it was expected that the final film would be dissolved and disappear, the disappearance was observed in the acid solution. At that time, the number of seconds consumed from the immersion to the disappearance of the final film in the acid solution was measured. The time required for dissolution and disappearance was calculated by totalizing all the numbers of seconds required up to the disappearance. By numerical values thus obtained, the strength of the film of test pieces was determined. The numerical values are defined as "anti-HCl power", having units of seconds.

The anti-HCl test is effected under such severe conditions that the erosion against film is strengthened and accelerated by low pH and high concentration of chloride ion, which concern the pitting deeply, and accordingly it is considered that a film tolerant of the solution for a longer period of time can tolerate for a long period also in general boiler water, compared with a film which is dissolved and disappears in the same solution within a shorter period of time.

The results obtained are shown in Table IV. From comparison of the anti-HCl powers of Nos. 15 and 16 with those of Nos. 31–39 (Comparative Examples), it is evident that the three ingredients of the present invention have a synergistic effect. Further, Nos. 20–30 show that various combinations of the three ingredients have an excellent effect. In contrast, Nos. 40 and 41 which give good results in the cooling system do not necessarily have a good effect at a high temperature, and not one of Nos. 43–45, which have been hitherto considered as effective combinations, has sufficient effect.

TABLE III

Water Condition of 10 Times Concentrated Water of Softened, Tap Water of Osaka-city

| Item | Unit | Value |
|---|---|---|
| pH (25° C.) | | 10.9 |
| Electric Conductivity | μs/cm | 2605 |
| P Alkalinity (as $CaCO_3$) | mg/l | 210 |
| M Alkalinity (") | " | 330 |
| Total Hardness (") | " | 0 |
| Calcium Hardness (") | " | 0 |
| Chloride Ion | " | 225 |
| Silica (as $SiO_2$) | " | 65.7 |
| Total iron | " | 0.51 |

TABLE IV

| Experiment No. | | Ingredient (a) (mg/l) | | Ingredient (b) (mg/l) | | Ingredient (c) (mg/l) | | Anti-HCl Power (sec) | Number of Pitting |
|---|---|---|---|---|---|---|---|---|---|
| Example | 10 | Nitrilotrimethylene-phosphonic acid | 100 | Sodium gluconate | 200 | $ZnSO_4.7H_2O$ | 40 | 42 | 0 |
| | 11 | Nitrilotrimethylene-phosphonic acid | 100 | " | 300 | " | 90 | 46 | 0 |
| | 12 | Nitrilotrimethylene-phosphonic acid | 100 | " | 200 | $MnSO_4.4H_2O$ | 50 | 46 | 0 |
| | 13 | Nitrilotrimethylene-phosphonic acid | 100 | " | 300 | " | 100 | 47 | 0 |
| | 14 | Nitrilotrimethylene-phosphonic acid | 100 | " | 300 | $NiCl_2.6H_2O$ | 120 | 42 | 0 |
| | 15 | Nitrilotrimethylene-phosphonic acid | 40 | " | 400 | $SnCl_2.2H_2O$ | 10 | 50 | 0 |
| | 16 | Nitrilotrimethylene-phosphonic acid | 40 | " | 100 | " | 10 | 38 | 0 |
| | 17 | Nitrilotrimethylene-phosphonic acid | 100 | " | 200 | " | 20 | 50 | 0 |
| | 18 | Nitrilotrimethylene-phosphonic acid | 100 | " | 200 | " | 40 | 175 | 0 |
| | 19 | Nitrilotrimethylene-phosphonic acid | 100 | " | 300 | " | 80 | 720 | 0 |
| | 20 | 1,1-Hydroxyethane-diphoshonic acid | 60 | Malic acid | 100 | $MnSO_4.4H_2O$ | 25 | 47 | 0 |
| | 21 | 1,1-Hydroxyethane- | 40 | Glycine diphoshonic | 300 | $SnCl_2.2H_2O$ | 20 | 65 | 0 |
| | 22 | $NaH_2PO_4$ | 60 | Nitrilotriacetic acid | 100 | $ZnSO_4.7H_2O$ | 80 | 44 | 0 |
| | 23 | $KH_2PO_4$ | 60 | Sodium gluconate | 200 | $MnSO_4.4H_2O$ | 40 | 46 | 0 |
| | 24 | " | 60 | Citric acid | 150 | $ZnSO_4.7H_2O$ | 20 | 43 | 0 |
| | 25 | Sodium hexametaphosphoric acid | 30 | " | 100 | " | 40 | 48 | 0 |
| | 26 | Sodium bispoly-2-carboxy-ethylphosphinate (m + n = 20) | 80 | Glycine | 200 | $SnCl_2.2H_2O$ | 10 | 54 | 0 |
| | 27 | Sodium bispoly-2-carboxy-ethylphosphinate (m + n = 20) | 80 | Sodium gluconate | 400 | " | 40 | 75 | 0 |
| | 28 | Sodium bispoly-2-carboxy-ethylphosphinate (m + n = 20) | 80 | Citric acid | 200 | $NiCl_2.6H_2O$ | 40 | 52 | 0 |
| | 29 | 1,1-Hydroxyethane-diphosphonic acid | 60 | Nitrilotriacetic acid | 100 | " | 60 | 44 | 0 |
| | 30 | Sodium hexametaphosphate | 45 | Gluconic acid | 100 | $ZnSO_4.7H_2O$ | 22 | 34 | 0 |
| | 31 | Nitrilotrimethylene-phosphonic acid | 350 | | | | | 8 | 1–10 |
| | 32 | | | Sodium gluconate | 350 | | | 12 | " |
| | 33 | | | | | $SnCl_2.2H_2O$ | 670 | 8 | More than 10 |
| | 34 | Nitrilotrimethylene-phosphonic acid | 300 | | | " | 50 | 18 | 1–10 |
| | 35 | Nitrilomethylene-phosphonic acid | 40 | | | " | 10 | 14 | " |
| | 36 | Nitrilomethylene-phosphonic acid | 175 | Sodium gluconate | 175 | | | 16 | " |
| | 37 | Nitrilomethylene-phosphonic acid | 40 | Sodium gluconate | 100 | | | 12 | " |

TABLE IV-continued

| Experiment No. | Ingredient (a) (mg/l) | | Ingredient (b) (mg/l) | | Ingredient (c) (mg/l) | | Anti-HCl Power (sec) | Number of Pitting |
|---|---|---|---|---|---|---|---|---|
| 38 | | | Sodium gluconate | 300 | $SnCl_2.H_2O$ | 50 | 25 | " |
| 39 | | | Sodium gluconate | 100 | " | 10 | 16 | " |
| 40 | Sodium hexametaphosphate | 45 | Sodium gluconate | 100 | | | 16 | " |
| 41 | Sodium hexametaphosphate | 45 | | | $ZnSO_4.7H_2O$ | 22 | 14 | " |
| 42 | | | Sodium gluconate | 100 | " | 22 | 11 | " |
| 43 | Nitrilotrimethyl-phosphonic acid | 40 | Citric acid | 100 | Sodium molybdate | 20 | 13 | " |
| 44 | Nitrilotrimethyl-phosphonic acid | 40 | " | 300 | Sodium molybdate | 10 | 14 | " |
| 45 | Nitrilotrimethyl-phosphonic acid | 40 | Sodium gluconate | 100 | $Zr(SO_4)_2.2H_2O$ | 20 | 23 | " |
| 46 | blank | | | | | | 5–8 | More than 10 |

EXAMPLE 2

The same test as Example 1 was effected by means of an autoclave, using a synthetic water obtained by 20 times concentration of a soft water prepared from tap water of Osaka-city. The results obtained are shown in Table VI. The water condition of the synthetic water is shown in Table V.

TABLE V-continued

| Water Condition of 20 Times Concentrated Water of Softened, Tap Water of Osaka-city | | |
|---|---|---|
| Item | Unit | Value |
| Total Iron | " | 1.11 |

TABLE VI

| Experiment No. | | Ingredient (a) (mg/l) | | Ingredient (b) (mg/l) | | Ingredient (c) (mg/l) | | Anti-HCl Power (sec) | Number of Pitting |
|---|---|---|---|---|---|---|---|---|---|
| Example | 47 | Nitrilotrimethyl-phosphonic acid | 40 | Sodium gluconate | 300 | $SnCl_2.2H_2O$ | 10 | 19 | 0 |
| | 48 | Nitrilotrimethyl-phosphonic acid | 60 | Sodium | 300 | $NiSO_4.6H_2O$ | 50 | 37 | 0 |
| | 49 | $KH_2PO_4$ | 40 | Nitrilotrimethyl-acetic acid | 80 | $ZnSO_4.7H_2O$ | 28 | 20 | 0 |
| | 50 | 1,1-Hydroxyethane-diphosphonic acid | 50 | Sodium Citrate | 200 | $MnSO_4.4H_2O$ | 40 | 18 | 0 |
| | 51 | 1,1-Hydroxyethane-diphosphonic acid | 50 | glycine Citrate | 250 | $SnCl_2.2H_2O$ | 20 | 22 | 0 |
| Comparative Example | 52 | blank | | | | | | 8–10 | More than 10 |
| | 53 | $KH_2PO_4$ | 60 | $N_2H_4.H_2O$ | 20 | | | 9–11 | 0 |

TABLE V

| Water Condition of 20 Times Concentrated Water of Softened, Tap Water of Osaka-city | | |
|---|---|---|
| Item | Unit | Value |
| pH (25° C.) | | 11.5 |
| Electric Conductivity | μs/cm | 5230 |
| P Alkalinity | mg/l | 421 |
| M Alkalinity | " | 666 |
| Total Hardness | " | 0 |
| Calcium Hardness | " | 0 |
| Chloride Ion | " | 502 |
| Sulfate Ion | " | 450 |
| Silica (as $SiO_2$) | " | 114 |

EXAMPLE 3 (Influence of temperature)

Tests were effected under the same conditions as Example 1, except that the test temperature was changed. The results are shown in Table VII.

As evident from the Table VII, especially high anti-HCl powers were recognized when the test piece were treated at temperatures of 150° C. or higher.

TABLE VII

| Test Temperature (°C.) | Ingredient (a) (mg/l) | | Ingredient (b) (mg/l) | | Ingredient (c) (mg/l) | | Anti-HCl power (sec) | Number of putting |
|---|---|---|---|---|---|---|---|---|
| 200 | Nitrilotrimethyl-phosphonic acid | 40 | Sodium gluconate | 300 | $SnCl_2.2H_2O$ | 10 | 50 | 0 |
| 150 | Nitrilotrimethyl-phosphonic acid | " | Sodium gluconate | " | " | " | 28 | 0 |
| 140 | Nitrilotrimethyl-phosphonic acid | " | Sodium gluconate | " | " | " | 13 | 0 |
| 130 | Nitrilotrimethyl-phosphonic acid | " | Sodium gluconate | " | " | " | 8 | 0 |
| 100 | Nitrilotrimethyl-phosphonic acid | " | Sodium gluconate | " | " | " | 5 | 0 |

REFERENTIAL EXAMPLE 2 (Influence of the amount of metal ion)

Additional tests were effected with the test temperature set at 200° C., in cases where the weight ratio of the carboxylic acid (b) to the metal ion (c) was less than 3.

The results are shown in Table VIII.

TABLE VIII

| Ingredient (a) (mg/l) | | Ingredient (b) (mg/l) | | Ingredient (c) (mg/l) | | Weight Ratio of Sodium gluconate to Metal ion | Anti-HCl Power (sec) | Number of Pitting |
|---|---|---|---|---|---|---|---|---|
| Nitrilotrimethyl-phosphonic acid | 40 | Sodium gluconate | 50 | $ZnSO_4$ (Anhydrous) | 62 | 2/1 | 22 | 1-10 Much Precipitates |
| Nitrilotrimethyl-phosphonic acid | " | Sodium gluconate | " | $SnCl_2.2H_2O$ | 48 | 2/1 | 30 | 2 Much Precipitates |

What is claimed is:

1. A method of anticorrosive treatment for soft water boilers which comprises adding to a boiler water system which uses soft water at a temperature of at least 150° C.: (a) at least one phosphorous compound selected from the group consisting of polyphosphoric acids, orthophosphoric acids and organophosphoric acids, in an amount of 10-200 mg/l, (b) at least one carboxylic acid compound selected from the group consisting of aliphatic hydroxycarboxylic acids and amino acids, in an amount of 40-500 mg/l, and (c) at least one metal compound that releases in water metal ions selected from the group consisting of tin ions, manganese ions and nickel ions, in an amount of 0.5-50 mg/l as metal ion, wherein the weight ratio of the compound (b) to the metal ions of the compound (c) is 3 or more, thereby preventing corrosion of iron family metals in the boiler water system.

2. A method of anticorrosive treatment as claimed in claim 1, wherein the temperature of the soft water is about 150° to about 250° C.

3. A method of anticorrosive treatment as claimed in claim 1, wherein the compound (a) is a polyphosphoric acid represented by the formula $(MPO_3)_n$ or $M_{m+2}P_mO_{3m+1}$, wherein M is selected from the group consisting of sodium, potassium or a hydrogen atom, or a combination thereof, n denotes an integer of 3-10, and m denotes an integer of 2-6, inclusive.

4. A method of anticorrosive treatment as claimed in claim 1, wherein the compound (a) is an orthophosphoric acid represented by the formula $M_3PO_4$, wherein M is selected from the group consisting of a hydrogen atom, sodium or potassium, or a combination thereof.

5. A method of anticorrosive treatment as claimed in claim 1, wherein the compound (a) is an organophosphoric acid represented by formula (I), formula (II), or formula (III), wherein formula (I) is:

$$[(MO)_3P(O)CH_2]_2-N[(CH_2)_mN]_k-CH_2P(O)(OM)_2 \quad (I)$$
$$\qquad\qquad\qquad\qquad\qquad\qquad | \qquad\qquad\qquad\qquad\qquad\